United States Patent [19]

Hsueh

[11] Patent Number: 4,830,631

[45] Date of Patent: May 16, 1989

[54] FUSE HOLDER FOR CONNECTING A FLAT-TYPE FUSE BLOCK BETWEEN A PAIR OF WIRES

[76] Inventor: Fu-Cheng Hsueh, No. 1045, Jen-Ai Tsun, Jen-Te Hsiang, Tainan Hsien, Taiwan

[21] Appl. No.: 237,495

[22] Filed: Aug. 26, 1988

[51] Int. Cl.[4] ..... H01R 33/95

[52] U.S. Cl. ..... 439/622; 337/187

[58] Field of Search ..... 439/621, 622, 682; 337/187, 188, 198

[56] References Cited

U.S. PATENT DOCUMENTS

| | | | |
|---|---|---|---|
| 3,060,293 | 10/1962 | Lapidus | 439/622 |
| 4,372,638 | 2/1983 | Sohler | 439/621 |
| 4,391,485 | 7/1983 | Urani | 439/621 |
| 4,560,227 | 12/1985 | Bukala | 439/621 |
| 4,648,674 | 3/1987 | Sanchez, Jr. | 439/622 |

FOREIGN PATENT DOCUMENTS

| | | | |
|---|---|---|---|
| 2511459 | 9/1976 | Fed. Rep. of Germany | 439/621 |

*Primary Examiner*—Gary F. Paumen

*Attorney, Agent, or Firm*—Limbach, Limbach & Sutton

[57] ABSTRACT

This invention discloses a fuse holder for connecting a flat-type fuse block between a pair of wires, the flat-type fuse block having a flat body with a pair of male terminals vertically and outwardly protruding from its inside, and a fuse disposed inside the flat body connecting the pair of male terminals. The improvement is characterized in that a hollow, flat, and insulated housing has an opening which is substantially correspondent to one side of the flat body through which the male terminals protrude and that a pair of female terminals are fixed within the housing and are adapted to fit with the pair of male terminals, each female terminal having a connector member for connecting with a pair of wires, the connector members protruding from the openning and extending therealong.

11 Claims, 4 Drawing Sheets

FUSE HOLDER FOR CONNECTING A FLAT-TYPE FUSE BLOCK BETWEEN A PAIR OF WIRES

BACKGROUND OF THE INVENTION

The present invention relates to a fuse holder for receiving a flat-type fuse block. More particularly, the present invention relates to a fuse holder for connecting a flat-type fuse block between a pair of wires, which minimizes the radial space of the connecting portion of the pair of wires when said pair is properly aligned and connected by a flat-type fuse block.

FIGS. 1 and 2 respectively show a partially exploded perspective view and elevational view of a conventional fuse holder for connecting a flat-type block 11 between a pair of wires 14, 14. The flat-type fuse block 11 comprises a pair of male terminals 111, 111 connected by a fuse strip 112 and a plastic shell body 113 for receiving the pair of male terminals 111 and fuse 112. One end of each male terminal 111 protrudes from the inside of the shell body 113 via one narrower side of the shell body 113 to form a plug portion 114 and another end of each male terminal 111 is exposed to the outside of the shell body 113 so as to be detected by an amperemeter through a hole formed on the other narrower side of the shell body 113.

The conventional fuse holder comprises a pair of female terminals 12, 12 and a pair of insulated sleeves 13,13. Each female terminal comprises a receptacle portion 121 fitted with the plug portion 114 of the fuse block 11, a first clamp portion 122 for being depressed to wrap the core 141 of the wire 14, and a second clamp portion 123 for being depressed to clamp the insulator 142 of the wire 14. Thus the fuse block 11 and the pair of wires 14, 14 can be connected and fixed by the pair of female terminals 12, 12. Each insulated sleeve 13 is hollow and has two opened ends adapted to sleeve onto the female terminal 12 connected with the plug portion 114 and one end of the wire 14 through the wire 14.

When the flat-type fuse block is connected with the pair of wires by the abovementioned fuse holder, it occupies a lot of radial space along the wires, as shown in FIG. 2. Therefore, if the many wires which are connected with the flat-type fuse block in the manner described hereinbefore need be gathered into a bundle, said flat-type fuse block will become an obstacle to said bundle. In addition, the end of the male terminal exposed to the outside of the shell body of the fuse block, and can be detected by means of an amperemeter, will give an electric shock to any person touching both ends of the same side of the pair of male terminals.

SUMMARY OF THE INVENTION

Therefore, the primary object of the present invention is to provide a fuse holder for connecting a flat-type fuse block between a pair of wires which minimizes the radial space of the connecting portion of the pair of wires when this pair is properly aligned and connected by a flat-type fuse block.

Another object of the present invention is to provide a fuse holder which comprises a cap adapted to cover the shell body of the flat-type fuse block so as to prevent an accidental electric shock.

The present invention provides a fuse holder for connecting a flat-type fuse block between a pair of wires, said flat-type fuse block having a flat body which has two broader sides separated by a series of narrower sides, a pair of male terminals correspondingly, vertically and outwardly protruded via one narrower side of said flat body from its inside, and a fuse disposed inside the flat body and connecting said pair of male terminals.

The improvement is characterized by:

a hollow, flat and insulated housing having two broader sides separated by a series of narrower sides, one of said narrower sides having an opening, said opening being substantially correspondent to said narrower side of said flat body, through which said male terminals are protruding; and a pair of female terminals fixed within said housing and adapted to mate with said pair of male terminals, each female terminal having a connector member for connecting with said pair of wires, said connector members protruding from the opening, extending along and departing from the site where said male terminals will be located while they are fitted with said female terminals. In this way, said fuse holder will minimize the radial space of the connecting portion of the pair of wires when this pair is properly aligned and connected by a flat-type fuse block.

The present invention further provides a cap adapted to cover said flat body of said flat-type fuse block so as to prevent an accidental electric shock.

These and other objects, features and advantages of the present invention will be more apparent in the following description of a preferred embodiment with reference to the accompanying drawings.

DETAILED DESCRIPTION OF THE PREFERRED EMBODIMENT

Figure 4:
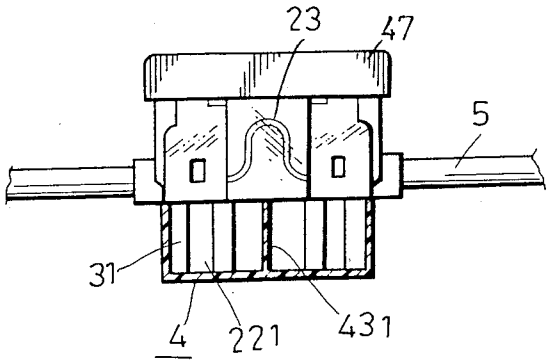
FIG. 4 is a elevational view of a preferred embodiment of the fuse holder shown in FIG. 3 for connecting a flat-type fuse block between a pair of wires.
Figure 3:
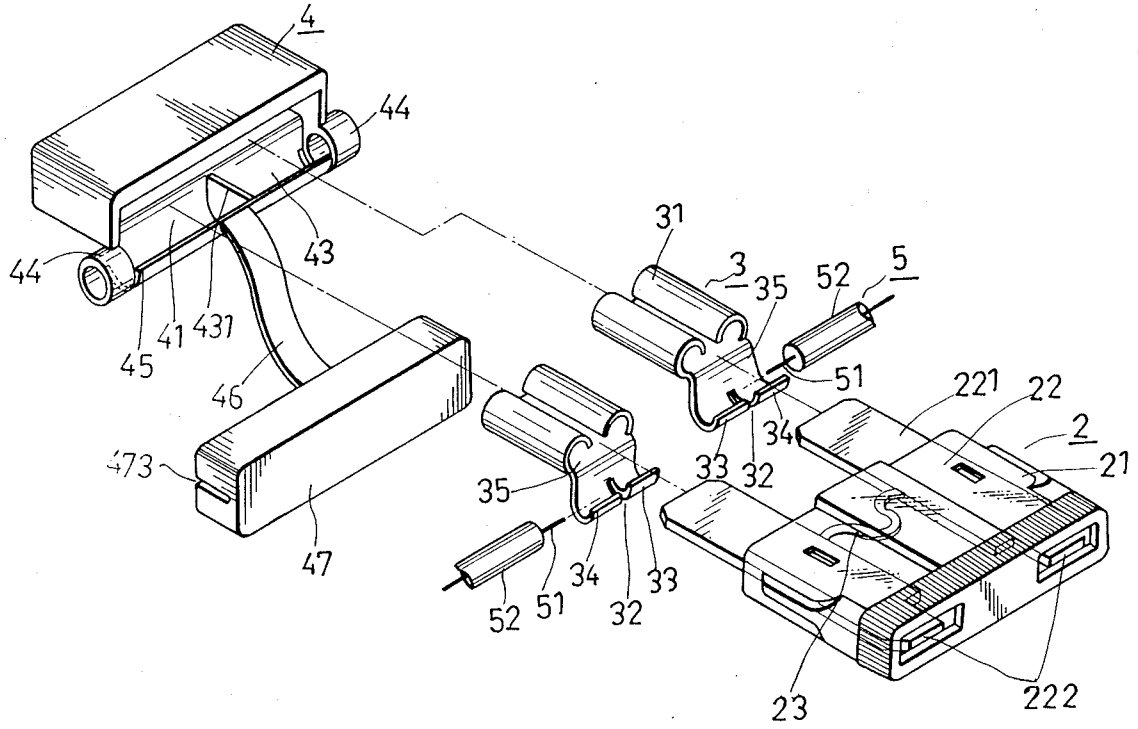
FIG. 3 is a exploded perspective view of a preferred embodiment of the fuse holder in accordance with the present invention.

Referring to figs.3 and 4, a preferred embodiment of a fuse holder in accordance with this invention illustrates a fuse holder comprising a pair of female terminals 3, 3 and an insulated housing 4 for connecting a flat-type fuse block 2 between a pair of wires 5, 5.

Said flat-type fuse block 2 comprises a plastic flat body 21 which has two broader sides separated by a series of narrower sides, a pair of male terminals 22, 22 vertically and outwardly protruding from one narrower side of said flat body from its inside to form a pair of plug portions 221, 221, the other two ends 222 of said pair of male terminals 22, 22 being exposed to the outside of said flat body so as to be checked by an amperemeter, and a fuse disposed inside the flat body and connecting said pair of male terminals.

Each female terminal comprises a receptacle portion 31 which is a rectanglar plate with two opposed curved sides so as to fit with one of said pair of male terminals 22 of the fuse block 2, and a connector member 35 for connecting with one of said pair of wires protruding from said receptacle portion 31, extending along and departing from the site where said male terminal will be located while it is fitted with said female terminal. Each connector member 35 is in the shape of an arced plate having a slot 32 transversely formed therein and circumferentially extending around its periphery, the connector member being divided by said slot 32 into two portions comprising a first clamp portion 33 and a second clamp portion 34. Said two first clamp portions 33,33 which are adapted to be depressed and wrapped respectively around the cores 51,51 of said pair of wires 5, are closer to each other than said two second clamp portions 34,34 adapted to be depressed and clamp respectively around the insulators 52 of said pair of wires 5.

Said insulated housing 4, which is hollow and flat, has two broader sides separated by a series of narrower sides, one of said narrower sides having an opening 41. Said opening 41 is substantially correspondent to said narrower side of said flat body of said fuse block 2, through which said male terminals 22 protrude. A trough member 43, longitudinally formed along one side of said opening 41, is in the shape of an arced plate so as to receive said connector members 35. Two hollow cylinders 44,44, each with an open end, extend respectively from two ends of said trough member 43 so that said pair of wires can pass therethrough. Two elongated notches 45, 45 are formed traversely between said two hollow cylinders 44,44 and said trough 43 respectively, circumferentially extending around the periphery of said trough 43, so as to increase the flexibility thereof. An insulated spacer plate 431 is formed in the central portion to prevent said pair of wires 5,5 from coming in contact with each other. A flexible strip 46 extends from said trough 43 and is connected with a cap 47 adapted to cover said flat body 21 of said fuse block 2. Two notches 473, 473, (one is not shown in FIG. 3) are formed extending from the periphery of said cap 47 so as to increase the flexibility of said cap 47.

Figure 1:
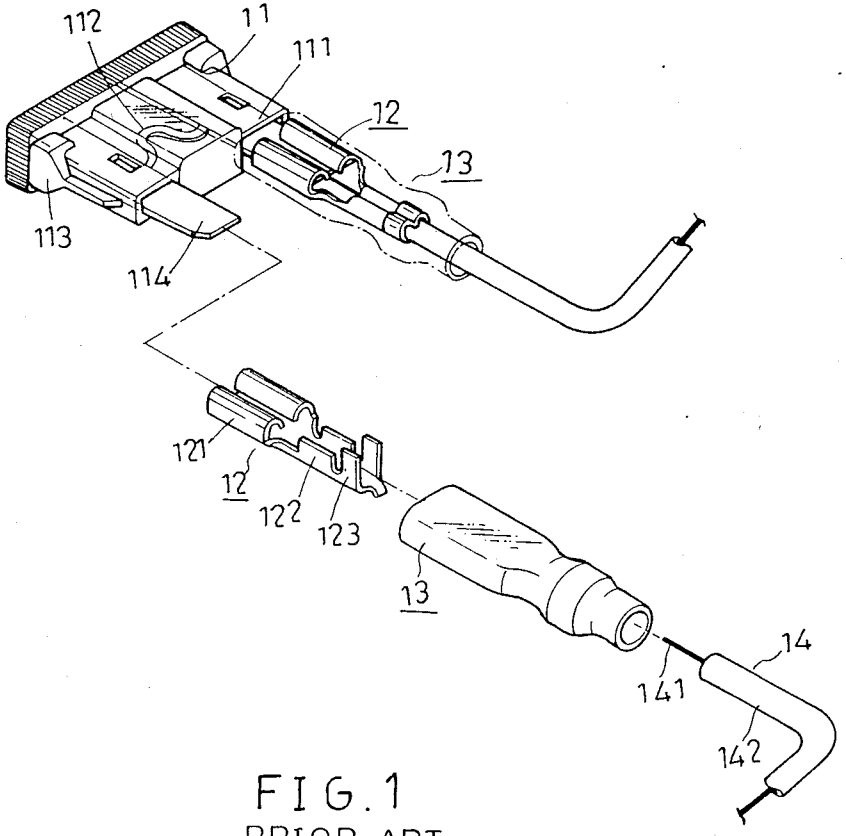
FIG. 1 PRIOR ART
FIG. 1 is a partially exploded, perspective view of a conventional fuse holder for connecting a flat-type fuse block between a pair of wires.
Figure 5:
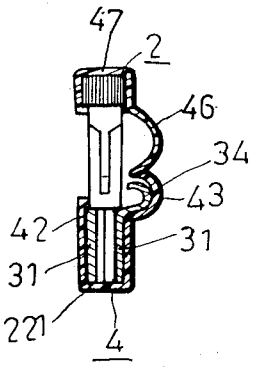
FIG. 5 is a side sectional view of a preferred embodiment of the fuse holder shown in FIG. 3 for connecting a flat-type fuse block between a pair of wires.
Figure 6:
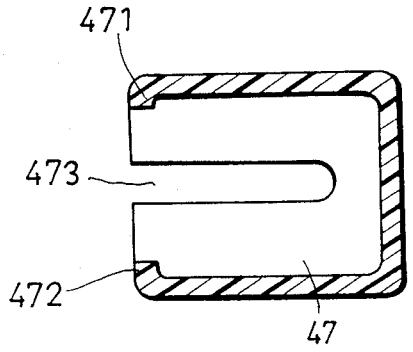
FIG. 6 is a side sectional view of a preferred embodiment of the cap of the fuse holder shown in FIG. 3 in accordance with the present invention.

Furthermore, an elongated detent 42 extends from the internal surface of the other side of said opening 41 for detachably fixing said receptacle portions 31 of said female terminals 3 within said housing 4 as shown in FIG. 5. Said cap 47 has two protrusions 471,472 formed respectively on the internal surface of said two broader sides of said cap 47, said protrusions 471,472 being adapted to engage with the periphery of said flat body of said flat-type fuse block, enabling said cap 47 to join stably with said flat body 21, as shown in FIG. 6.

Figure 2:
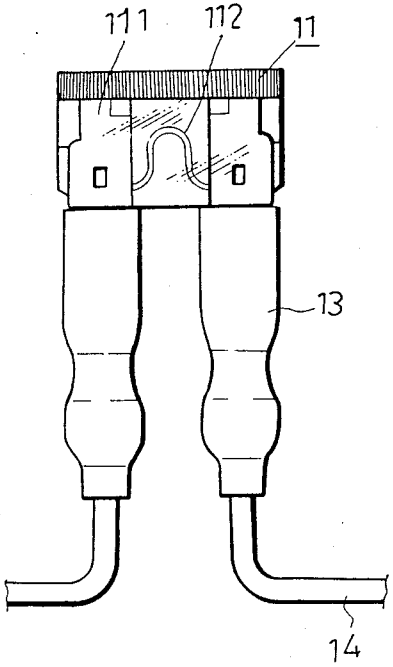
FIG. 2 PRIOR ART
FIG. 2 is an elevational view of a conventional fuse holder for connecting a flat-type fuse block between a pair of wires.

As a result, said pair of terminals 3 can be fitted into said housing 4. Then said pair of wires 5 may be passed through said hollow cylinders 44 and can be connected by depressing said connector members 35 on said wires 5 in said trough 43. Said fuse block 2 may then be inserted into said housing 4 with said plug portions 221 of said male terminals 22 mating with said receptacles 31 of said female terminals 3. Lastly, said cap 47 may be sleeved onto one side said flat body 21 to cover said two ends 222 of said pair of male terminals 22 so as to prevent an electric shock as a results of touching said two ends 222. After the combination of all elements above-mentioned, a preferred embodiment of a fuse holder may be realized for connecting a flat-type fuse block between a pair of wires (as showon in FIG. 4), which occupies much less radial space along said wires than a conventional fuse holder as shown in FIG. 2.

The above embodiment is given by way of example only. Various modifications will be apparent to persons skilled in the art without departing from the scope of the invention defined by the appended claims.

What I claim is:

1. A fuse holder for connecting a flat-type fuse block between a pair of wires, said flat-type fuse block having a flat body which has two broad sides separated by a series of narrower sides, a pair of male terminals vertically and outwardly protruding through one said narrower side of said flat body from the inside thereof, and a fuse disposed inside the flat body connecting said pair of male terminals, wherein the improvement is characterized by:

a hollow, flat insulated housing having two broad sides separated by a series of narrower sides, one of said narrower sides having an opening, said opening adapted to receive said male terminals; and a pair of female terminals fixed within said housing and adapted to mate with said pair of male terminals, each said female terminal having a connector member which is adapted to be joined to one of said wires, said connector members protruding from said opening and extending therealong.

2. A fuse holder as claimed in claim 1, wherein said housing further comprises a trough member longitudinally formed along one side of said opening so as to receive said connector members therein, said trough member having two open ends so as to enable said pair of wires to pass therethrough.

3. A fuse holder as claimed in claim 2, wherein said connector members are in the shape of arced plates which may be conveniently depressed so as to clamp said pair of wires.

4. A fuse holder as claimed in claim 3, wherein said trough member is in the shape of an arc so as to receive said connector members.

5. A fuse holder as claimed in claim 4, wherein said trough has at least one notch formed traversely between said two open ends of said trough, circumferentially extending around the periphery of said trough, so as to increase the flexibility thereof.

6. A fuse holder as claimed in claim 5, wherein each said connector member has a slot traversely formed therein, circumferentially extending around the periphery thereof.

7. A fuse holder as claimed in claim 6, wherein said housing has an elongated detent formed on an internal surface of one of said two broad sides thereof detachably fixing said female terminals within said housing.

8. A fuse holder as claimed in claim 1, 2, 3, 4, 5, 6, or 7, further comprising a cap adapted to cover said flat body of said flat-type fuse block.

9. A fuse holder as claimed in claim 8, wherein said cap is connected with said housing by means of a flexible strip.

10. A fuse holder as claimed in claim 9, wherein said cap has at least one protrusion formed on its internal surface, said protrusion being adapted to engage with the periphery of said flat body of said flat-type fuse block, enabling said cap to stably join with said flat body.

11. A fuse holder as claimed in claim 10, wherein said cap has at least one notch extending along its periphery, so as to increase its flexibility.

* * * * *